US010222762B2

(12) United States Patent
Balli et al.

(10) Patent No.: US 10,222,762 B2
(45) Date of Patent: Mar. 5, 2019

(54) METHOD OF MANAGING AN ELECTRONIC APPARATUS

(71) Applicant: ETA SA Manufacture Horlogere Suisse, Grenchen (CH)

(72) Inventors: Fabien Balli, Orpund (CH); Stephane Claude, Grenchen (CH); Jean Laconte, Colombier (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/415,044

(22) PCT Filed: Jul. 3, 2013

(86) PCT No.: PCT/EP2013/063996
§ 371 (c)(1),
(2) Date: Jan. 15, 2015

(87) PCT Pub. No.: WO2014/012790
PCT Pub. Date: Jan. 23, 2014

(65) Prior Publication Data

US 2015/0168923 A1 Jun. 18, 2015

(30) Foreign Application Priority Data

Jul. 18, 2012 (EP) ..... 12176938

(51) Int. Cl.
*G04G 19/00* (2006.01)
*G04G 19/12* (2006.01)
*G04C 10/00* (2006.01)

(52) U.S. Cl.
CPC ..... *G04G 19/12* (2013.01); *G04C 10/00* (2013.01); *G04G 19/00* (2013.01)

(58) Field of Classification Search
CPC ..... G04C 10/00; G04G 19/00; G04G 19/12
(Continued)

(56) References Cited

U.S. PATENT DOCUMENTS 4,862,431 A * 8/1989 Drouin ..... G04B 47/00 131/270
5,596,551 A * 1/1997 Born ..... G01C 17/30 33/271

(Continued)

FOREIGN PATENT DOCUMENTS

EP 0 952 500 A1 10/1999
EP 1 752 841 A1 2/2007

(Continued)

OTHER PUBLICATIONS

Kasuo, English Translation for JP 2010117286, May 27, 2010.*
International Search Report dated Sep. 6, 2013 in PCT/EP2013/063996 Filed Jul. 3, 2013.

*Primary Examiner* — Daniel Wicklund
(74) *Attorney, Agent, or Firm* — Oblon, McClelland, Maier & Neustadt, L.L.P.

(57) ABSTRACT

A method of managing an electronic apparatus including a case containing a microcontroller powered with electrical energy by an electrical energy storage and connected to a time base, a mechanism of measuring light intensity, a mechanism of detecting whether the apparatus is being worn, the microcontroller also being connected to a first display and a second display, arranged, in an active operating mode, to be controlled by the electronic control circuit to display at least a first temporal data item at least provided by the time base.

38 Claims, 3 Drawing Sheets

(58) Field of Classification Search
USPC ..... 368/66, 68, 203, 204
See application file for complete search history.

(56) References Cited

U.S. PATENT DOCUMENTS

| | | | | |
|---|---|---|---|---|
| 5,883,861 | A * | 3/1999 | Moser | G04B 25/04 33/263 |
| 6,320,822 | B1 | 11/2001 | Okeya et al. | |
| 6,792,319 | B1 * | 9/2004 | Bilger | G05B 15/02 700/12 |
| 8,041,328 | B2 * | 10/2011 | Orr | G06F 1/3203 340/669 |
| 2003/0165083 | A1 * | 9/2003 | Maruyama | G04G 19/12 368/28 |
| 2004/0246821 | A1 * | 12/2004 | Fujisawa | G04G 19/12 368/204 |
| 2005/0157592 | A1 * | 7/2005 | Nakamura | G04R 20/08 368/47 |
| 2006/0203617 | A1 * | 9/2006 | Matthey | G01C 17/30 368/11 |
| 2006/0268666 | A1 * | 11/2006 | Lizzi | G04C 17/00 368/223 |
| 2006/0285442 | A1 * | 12/2006 | Maeder | G04G 21/02 368/11 |
| 2007/0195074 | A1 * | 8/2007 | Gelissen | G06F 1/3228 345/204 |
| 2008/0267015 | A1 * | 10/2008 | Zhang | G04G 15/006 368/10 |
| 2009/0168608 | A1 * | 7/2009 | Lan | G04G 15/003 368/10 |
| 2009/0296533 | A1 | 12/2009 | Kojima | |
| 2010/0091615 | A1 * | 4/2010 | Scott | G04G 9/0076 368/21 |
| 2010/0194573 | A1 * | 8/2010 | Hoover | G04B 47/06 340/573.1 |
| 2012/0082013 | A1 * | 4/2012 | Yeung | G04C 3/002 368/274 |
| 2012/0140601 | A1 * | 6/2012 | Nakagawa | G04G 19/12 368/10 |
| 2013/0058197 | A1 * | 3/2013 | Yonekura | G04G 19/12 368/10 |
| 2013/0188460 | A1 * | 7/2013 | Ihashi | G04B 99/00 368/66 |

FOREIGN PATENT DOCUMENTS

| | | | |
|---|---|---|---|
| EP | 2 128 720 | A2 | 12/2009 |
| JP | 2010-117286 | A | 5/2010 |

* cited by examiner

METHOD OF MANAGING AN ELECTRONIC APPARATUS

The invention concerns an electronic apparatus comprising a case containing an electronic control circuit powered with electrical energy by an electrical energy storage means and connected to a time base, a light intensity measuring means, and a means of measuring the motion to which said apparatus is subjected, said electronic control circuit being also connected to a first display means and a second display means arranged, in an active operating mode, to be controlled by the electronic control circuit to display at least data provided by the time base.

BACKGROUND OF THE INVENTION

It is known that electronic apparatuses have the drawback of having an energy source which discharges over time. Consequently, there exist methods of managing the energy of the electronic apparatus so that the energy source has the longest possible autonomy. For this purpose, various energy managing methods have been invented and generally speaking, after the actuation of a trigger element, these energy saving methods consist in stopping the highest electricity consuming function such as the LCD display or the motion of the hands.

For example, management methods are known wherein the trigger element is the actual user. The user controls the start of the energy saving mode himself. To achieve this, he operates push buttons or other control means of the electronic apparatus to activate the energy saving mode.

One drawback of this method is that the user is not methodical. Indeed, the user will not always start the energy saving mode when it is required. He will activate this mode when he leaves for a few days but not necessarily every night. Optimum energy saving is therefore not achieved.

Methods are also known wherein the activating element is based on the level of a physical magnitude. For example, activation may occur when the ambient light falls below a certain threshold indicating that the electronic apparatus is in darkness. Activation may occur when the electronic apparatus detects that it is no longer being worn. This is achieved by the use of an accelerometer which is sensitive to any motion of the electronic apparatus.

One drawback of these methods is that the energy saving mode may be activated spontaneously when it is not required or desired. Indeed, if the electronic apparatus spends extended time in a tunnel or inside a sleeve, or if the user wearing the apparatus falls asleep so that said apparatus detects a lack of motion, the energy saving mode may be activated unnecessarily. The functions are then deactivated and the user no longer has immediate access to data and has to reactivate the normal mode to achieve access. This therefore becomes a source of irritation for the user.

SUMMARY OF THE INVENTION

It is an object of the invention to overcome the drawbacks of the prior art by proposing to provide an electronic apparatus whose energy management method is reliable and which offers a longer battery life.

The invention therefore concerns a method of managing an electronic apparatus comprising a case containing a microcontroller powered with electrical energy by an electrical energy storage means and connected to a time base, a means of measuring light, and means of detecting when said apparatus is being worn, said microcontroller also being connected to a first display means comprising at least one hand set in motion by an electric motor, and a second display means comprising at least one digital screen arranged, in an active operating mode, to be controlled by the microcontroller to display at least a first temporal data item at least supplied by the time base, the method including the steps of:

a) displaying at least said first temporal data item at least supplied by the time base corresponding to one said active operating mode;

b) testing a first criterion linked to a second temporal data item supplied by the time base; if the first test is satisfied, going to the next step, otherwise repeating said step a);

c) testing a second motion-linked criterion supplied by the means of detecting whether said apparatus is being worn; if the third test is satisfied, going to the next step, otherwise repeating said step a);

characterized in that said method further includes a step d) consisting in testing a third criterion representative of a physical magnitude so that, when the first, second and third criteria are satisfied, the change from the active operating mode to a standby mode occurs and in that steps b), c) and d) are performed until the first, second and third criteria are satisfied and at regular intervals, calculated so that the position of the rotor of the electric motor of said at least one hand is identical in steps b), c) and d) to cause the least possible interference.

The invention therefore concerns a method of managing an electronic apparatus comprising a case containing a microcontroller powered with electrical energy by an electrical energy storage means and connected to a time base, a means of measuring light, and a means of detecting whether said apparatus is being worn, said microcontroller also being connected to a first display means comprising at least one hand set in motion by an electric motor, and a second display means comprising at least one digital screen arranged, in an active operating mode, to be controlled by the microcontroller to display at least a first temporal data item at least supplied by the time base, the method including the steps of:

a) displaying at least said first temporal data item at least supplied by the time base corresponding to one said active operating mode;

b) testing a first criterion linked to a second temporal data item supplied by the time base; if the first test is satisfied, going to the next step, otherwise repeating said step a);

c) testing a second motion-linked criterion supplied by the means of detecting whether said apparatus is being worn; if the third test is satisfied, going to the next step, otherwise repeating said step a);

characterized in that said method further includes a step d) consisting in testing a third criterion representative of a physical magnitude so that, when the first, second and third criteria are satisfied, the change occurs from the active operating mode to a standby mode.

This method thus has the advantage of being reliable since it uses a higher number of criteria which makes errors more rare. Indeed, by combining a time-linked criterion, a motion-linked criterion and a last criterion that may be linked to the time or to the ambient light, there is a reduced risk of errors and of unnecessarily placing the apparatus in standby mode.

In a first advantageous embodiment, the third criterion is linked to a light intensity data item supplied by the light intensity measuring means, said third criterion allowing the change from the active operating mode to a short standby mode in which the first display means is stopped.

In a second advantageous embodiment, step d) consists in comparing a light intensity value measured by said light intensity measuring means to a first light intensity threshold, the second criterion being validated if the measured light intensity value is lower than or equal to said first light intensity threshold.

In a third advantageous embodiment, step b) consists in comparing a time measurement made by the time base to a first time interval, the first criterion being satisfied if said time measurement by the time base is comprised within said first time interval.

In another advantageous embodiment, the first criterion is tested first of all, and the second and third criteria are tested simultaneously when the first criterion is satisfied.

In another advantageous embodiment, the third criterion consists in testing the value of a counter with respect to a first counter value, this third criterion permitting the change from the active operating mode to a long standby mode in which the first display means and the second display means are stopped.

In another advantageous embodiment, step b) consists in comparing a time data item delivered by the time base to a second time value, said fourth criterion being satisfied when said time data item delivered by the time base is identical to the second time value.

In another advantageous embodiment, the first criterion is tested first of all, and the second criterion is tested when the first criterion is satisfied, and when the second criterion is satisfied, the counter value is incremented and the third criterion is tested.

In another advantageous embodiment, step c), designed to test a second criterion linked to motion data provided by the means of detecting whether said apparatus is being worn, consists in:

at an instant Ti, performing a first measurement of the position of said apparatus via the detection means of said apparatus;

comparing said first measurement to a second measurement stored in a memory element and performed at an instant ti−1, the third criterion being validated if the first and second measurements are identical, otherwise replacing the memory element value with the first measurement performed at instant Ti.

In another advantageous embodiment, the method further includes a step f) designed to change from the short standby mode to the normal operating mode, said step consisting in testing a first event and in changing from the short standby mode to the normal operating mode if the test of the first event is positive.

In another advantageous embodiment, the method further includes a step F) designed to change from the long standby mode to the normal operating mode, said step consisting in testing a second event and in changing from the short standby mode to the normal operating mode if the test of the second event is positive.

In another advantageous embodiment, the action designed to test a first event consists in detecting a change of electrical state of the means activation.

In another advantageous embodiment, the action designed to test a first event consists in comparing a measured physical magnitude to a reference value of said physical magnitude, the first event being satisfied if said measured physical magnitude is identical to said reference value of said physical magnitude.

In another advantageous embodiment, the measured physical magnitude is light intensity, the measured light intensity value being compared to a light intensity threshold.

In another advantageous embodiment, said second light intensity threshold is identical to the first light intensity threshold.

In another advantageous embodiment, the measured physical magnitude is a temporal data item, the measured time data being compared to a third time value.

In another advantageous embodiment, steps b), c) and d) are performed every eight minutes until the first, second and third criteria are satisfied so as to generate the least possible interference.

The method also has the advantage of being flexible in the sense that the criteria can be selected according to the desired standby modes. Further, the various thresholds for satisfying or not satisfying the criteria can be determined by the user according to his lifestyle.

The invention also concerns an electronic apparatus comprising a case containing a microcontroller powered with electrical energy by an electrical energy storage means and connected to a time base, a means of measuring light, and a means of detecting whether said apparatus is being worn, said microcontroller also being connected to a first display means and a second display means arranged, in an active operating mode, to be controlled by the electronic control circuit to display at least a first temporal data item at least provided by the time base and a standby operating mode, said microcontroller activating the change from the active operating mode to the standby operating mode according to a first criterion linked to a second temporal data item supplied by the time base and a second criterion linked to a motion data item supplied by the means of detecting whether said apparatus is being worn, characterized in that the change from the active operating mode to the standby operating mode is also carried out in accordance with a third criterion representative of a physical or temporal magnitude.

In another advantageous embodiment, the third criterion is linked to a light intensity data item supplied by the light intensity measuring means, said third criterion allowing the change from the active operating mode to a short standby mode in which the first display means is stopped.

In another advantageous embodiment, the light intensity data is obtained by comparing a light intensity value measured by said light intensity measuring means to a first light intensity threshold.

In another advantageous embodiment, the first criterion consists in comparing a time measurement made by the time base to a first time interval in order to tell whether said time measurement by said time base is comprised within said first time interval.

In another advantageous embodiment, the third criterion consists in testing the value of a counter with respect to a first counter value, this third criterion permitting the change from the active operating mode to a long standby mode in which the first display means and the second display means are stopped.

In another advantageous embodiment, the first criterion consists in comparing a temporal data item delivered by the time base to a second time value, said first criterion being satisfied when said time data delivered by the time base is identical to the second time value.

In another advantageous embodiment, the motion data supplied by the means of detecting whether said apparatus is being worn consists in performing, at an instant Ti, a first position measurement of the position of said apparatus and in comparing said first measurement to a second measurement stored in a memory element, the third criterion being validated if the first and second measurements are identical.

In another advantageous embodiment, the means of detecting whether said apparatus is being worn consists of a magnetic sensor.

In another advantageous embodiment, the magnetic sensor is replaced by an accelerometer which is arranged inside the case and which includes at least one measurement axis of the acceleration to which the watch is subjected.

In another advantageous embodiment, the means of detecting whether the watch is being worn consists of a thermoelectric sensor, the motion data supplied by the thermoelectric sensor consisting in the comparison of a measurement made by the thermoelectric sensor to a temperature threshold representative of body temperature.

In another advantageous embodiment, the first display means includes at least one hand set in motion by an electric motor and the second display means includes at least one digital screen.

BRIEF DESCRIPTION OF THE DRAWINGS

The objects, advantages and features of the electronic apparatus according to the present invention will appear more clearly in the following detailed description of at least one embodiment of the invention, given solely by way of non-limiting example and illustrated by the annexed drawings, in which.

DETAILED DESCRIPTION OF THE INVENTION

Figure 1:
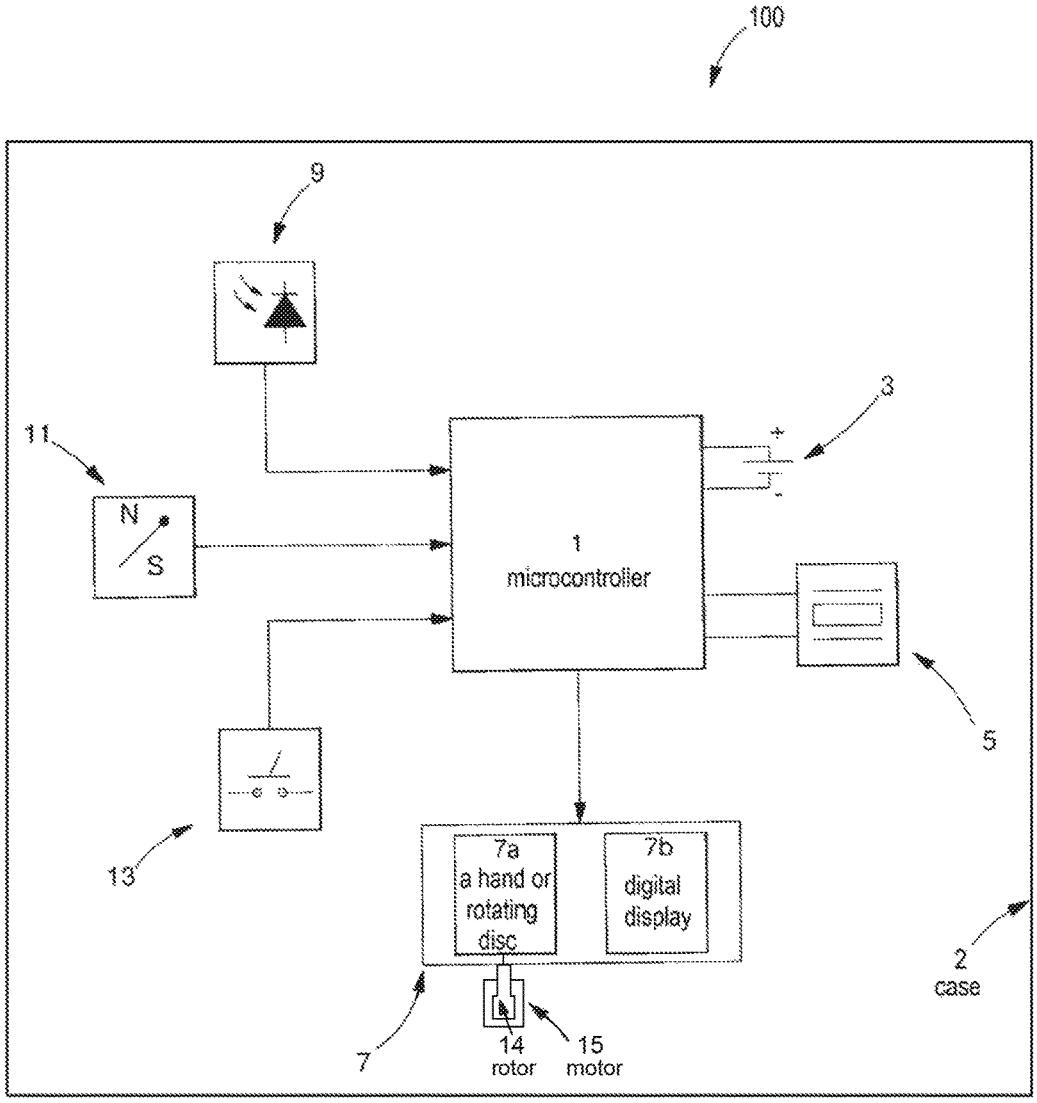
FIG. 1 is a schematic view of the electronic apparatus according to the invention.

FIG. 1 shows an electronic apparatus 100 according to the present invention. This electronic apparatus 100 includes a microcontroller 1 supplied with energy by an electric power source 3. This electric power source 3 may be a battery or a supercapacitor or accumulator charged by a rotor or a solar cell or an external connection or any other possible charging means. Electrical apparatus 100 further includes a time base 5, for example a quartz delivering a set frequency signal. The set frequency signal is used so that the microcontroller can supply time representative signals which are sent to the display means 7. Display means 7 may be analogue and/or digital means. In the example used, electronic apparatus 100 includes analogue display means 7*a* and digital display means 7*b*. For example, analogue display means 7*a* are hands or rotating discs, whereas digital display means 7*b* is a digital screen such as an LCD or OLED or other type of screen.

Analogue display means 7*a* and digital display means 7*b* are also used for displaying data other than time data. Indeed, electronic apparatus 100 may also comprise a means 10 of detecting whether said apparatus 100 is being worn, such as a magnetic sensor 11 with two or three axes used to supply orientation data and acting as a compass. Electronic apparatus 100 may also comprise a light sensor 9 such as a photodiode or solar cell. The photodiode may, for example, switch on backlighting if the ambient light drops too much, whereas the solar cell may charge the accumulator and act as a light sensor for switching on backlighting. Magnetic sensor 11 and light sensor 9 are connected to microcontroller 1. Electronic apparatus 100 also includes an activation means 13 such as push buttons or touch zones or suchlike, allowing the user to act on said electronic sensor 100.

This electronic apparatus 100 may include a case 2 and may be a portable apparatus such as a watch, or a portable navigation device or a portable communication device. In the following description, the example of a watch will be used for electronic apparatus 100.

Advantageously, magnetic sensor 11 and light sensor 9 are used to determine the change of electronic apparatus 100 into the various operating modes.

Indeed, electronic apparatus 100 operates in several operating modes. A first "normal" operating mode called step a) or A), is an operating mode in which the electric power consumption is not limited and in which the data supplied by time base 5 and/or magnetic sensor 11 and/or light sensor 9 are displayed via analogue display means 7*a* and digital display means 7*b*. Preferably, the data provided by time base 5 is displayed by analogue display means 7*a* and the data provided by magnetic sensor 11 and/or light sensor 9 is displayed by digital display means 7*b*.

Electronic apparatus 100 is arranged to operate in different standby modes. To start the various standby modes, criteria must be satisfied. In each case, a certain number of criteria are common to the various standby modes.

A first criterion is linked to a temporal data item. Indeed, a temporal criterion is required in order for microcontroller 1 to establish that watch 100 is in a state indicating that standby is possible. This criterion may be a precise time data item, a time interval, the fact that a criterion is repeated in time or suchlike.

A second criterion is linked to a motion data item. Indeed, this is an important criterion since if the microcontroller detects that said watch 100 is moving, this means that it is being worn. If it is being worn, standby should not be envisaged.

Advantageously according to the invention, electronic apparatus 100 is arranged so that standby mode is activated by using a third criterion representative of a physical or temporal magnitude so that if the three criteria are satisfied, the standby modes are activated.

The electronic apparatus is thus arranged to operate in two standby modes: a short standby mode and a long standby mode.

Figure 2:
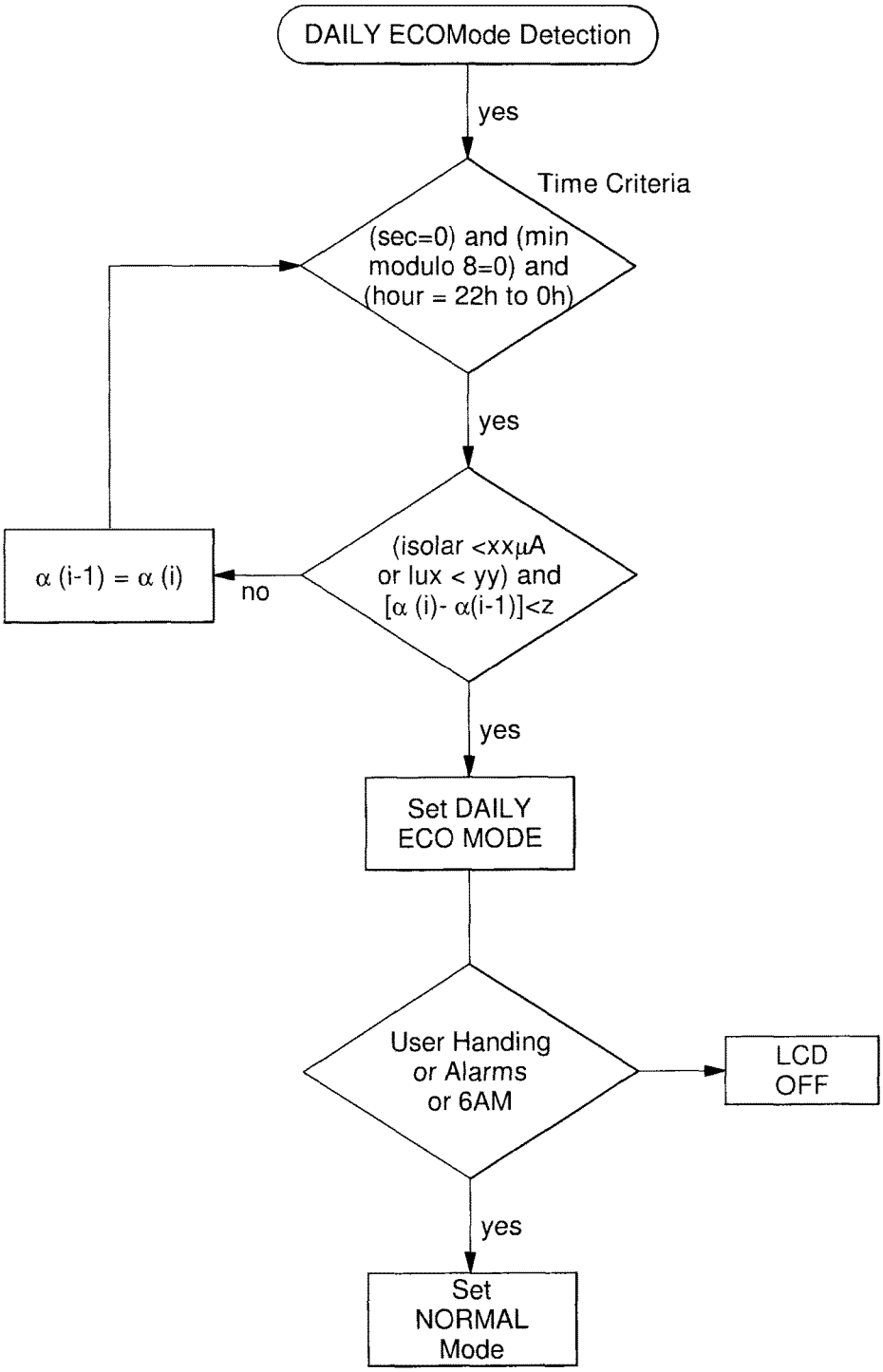
FIG. 2 is a schematic view of the short standby mode diagram of the invention.

In a first embodiment, the short standby mode, shown in a diagram in FIG. 2, is arranged to be activated when watch 100 is not worn for several hours. For example, this short standby mode is activated at night when the user is no longer wearing watch 100. In order to trigger activation of the short standby mode, criteria must be satisfied. The purpose of these criteria is to let the microcontroller know that watch 100 is in a state in which it can be placed in standby mode.

For the short standby mode, activation by microcontroller 1 occurs when a combination of three criteria are satisfied. These three criteria reliably determine that watch 100 must be placed in short standby mode.

In a step called step b), a first criterion is tested. The first criterion is linked to a temporal data item. This criterion consists in observing a first time interval. This means that watch 100 will deem that the first criterion is validated if, at a given instant, the measured time is comprised within said first interval. For example, a first selected interval is the interval from 2200 hours to 2400 hours. This therefore means that each day, microcontroller 1 compares the time data item provided by time base 3 to the first defined interval, namely the interval from 2200 hours to 2400 hours. The temporal criterion will be validated when the current time is comprised within said first interval from 2200 hours to 2400 hours. This example time interval is chosen as it is assumed that most users sleep during this interval. This is therefore a suitable time to change to standby mode to save energy.

It is thus clear that each day, microcontroller 1 tests the various criteria. If the first criterion is satisfied, subsequent steps are carried out, otherwise the first criterion is tested again in step b).

A step, called step c), consists in testing the second criterion which is linked to motion or orientation data. Magnetic sensor 11 having two or three axes is used for this purpose. This magnetic sensor 11 is used to provide measurements representative of the orientation of watch 100 at regular intervals, and to compare the measurements to each other. If microcontroller 1 detects that the orientation of watch 100 at an instant Ti is identical to the orientation of watch 100 at an instant Ti−1 saved in a memory element, it deduces that watch 100 is not being worn by the user. By associating this result with the results of the first and second criteria, microcontroller 1 deduces that watch 100 is situated, late at night: between 2200 hours and 2400 hours, in a dark environment and is not moving. Consequently, there is a high probability that watch 100 is placed for example on the user's bedside table.

However, if the orientation of watch 100 at an instant Ti is not identical to the orientation of watch 100 at an instant Ti−1, the orientation data for watch 100 at instant Ti is saved in a memory element and becomes the instant Ti−1 for a subsequent measurement.

Another step, called step d), consists in testing the third criterion, which is linked to light intensity data. This criterion consists of a light intensity data item, measured by light sensor 9 and then compared to a first predetermined light intensity threshold. Thus, when the light measured by the light sensor is lower than or equal to the first predetermined light intensity threshold, microcontroller 1 considers that watch 100 is in a dark environment. The light criterion is consequently satisfied and the short standby mode can be activated. When the first and second criteria are satisfied, microcontroller 1 deduces that watch 100 is in a dark environment between 2200 hours and 2400 hours.

If the second and third criteria are not satisfied, then the first criterion test is repeated.

It is clear that the first criterion, the second criterion and the third criterion may be tested one after the other. The order of the tests may be such that the first criterion is tested first, the second criterion second and the third criterion last. However, it is possible to envisage the first criterion being tested first and the second criterion and third criterion being tested simultaneously when the first criterion is satisfied.

However, once the three criteria are satisfied, microcontroller 1 will pass to step e), i.e. will activate the change of operating mode of watch 100 so that the watch changes from normal mode to short standby mode. This short standby mode is characterized by the deactivation of digital display means 7*b*. This deactivation limits electric power consumption by not using digital display means 7*b* which is a high energy consumer.

The association of three criteria has the advantage of preventing the short standby mode from being activated when the user is working at night in a dark environment or when the user exceptionally has a late night.

The various values for the first time interval of the first criterion, the first threshold light intensity value of the third criterion and the time interval between two orientation measurements are set and configured by the user. For the light intensity threshold, this is set by the manufacturer at 30 lux, but this threshold may be adapted to environmental conditions. For the first criterion time interval, this is set by the manufacturer at between 2200 hours and 2400 hours. The user may change the interval as required depending on his habits. Indeed, a person with a different schedule may adjust the light intensity threshold and the time interval to fit his schedule.

As regards the measurement interval between two orientation measurements of watch 100, this is variable and may be set to any possible value. Nonetheless, this time interval may be set so that the measurements permitting the change into short standby mode use the least possible amount of energy. Indeed, the mere fact of performing light intensity measurements or orientation measurements uses electrical energy causing electric power source 3 to discharge. These measurements must not, therefore, be too frequent, so that power source 3 is not needlessly discharged.

In the present case, the time interval is set at eight minutes. This eight minute interval is selected since it offers a good compromise between measurement frequency and electric power consumption. Indeed, if measurements are applied at an eight minute frequency in the time interval between 2200 hours and 2400 hours, namely a two-hour interval, it is observed that magnetic sensor 11 and microcontroller 1 will have to measure and process fifteen measurements.

Moreover, this eight minute interval has the advantage of not disrupting the measurements. The motors driving the hour and minute hands are formed of magnetic elements which means that there is a magnetic influence on magnetic sensor 11. Every eight minutes, the rotors of the motors of the hour and minute hands are in the same position, where a non-limiting illustrative example of such a rotor of a motor is shown as rotor 14 of motor 15 in FIG. 1. The influence of these rotors is thus identical from one magnetic measurement to another. If the time interval were shorter or longer than eight minutes, the rotors of the motors would have a different effect which would have changed the magnetic measurements.

To leave the short standby mode and return to normal operating mode, a step f) is provided in which a first event is tested and allows the change from short standby mode to normal operating mode. To achieve this, there are several possible solutions for the first event.

Firstly, one solution consists in returning to normal operating mode when the user acts on activation means 13. Indeed, an action by the user on a push button informs microcontroller 1 that watch 100 is being worn by the user or at least that it is being used which requires the change from standby mode to normal operating mode. Pressing activation means 13 results in a change of electrical state which causes microcontroller 1 to detect the pressing action. In response, the microcontroller will change watch 100 into normal operating mode. Microcontroller 1 then reactivates digital display means 7*b* which displays time data again.

Secondly, a solution consists in returning to normal operating mode when an event occurs. It is clear that this event may be the comparison of a measured physical magnitude to a reference value of said physical magnitude. The physical magnitude is, for example, linked to a horological event such as the release of a time alarm. However, this event may be linked to any of the functions of watch 100. For example, the user may set watch 100 so that an acoustic alarm rings at 0700 hours. Activation of the acoustic alarm then causes microcontroller 1 to activate the normal operating mode. It is clear that the measured physical magnitude, which is a temporal data item, is compared to a third time value.

Likewise, the physical magnitude may be linked to sensors. Thus, the acoustic alarm may be coupled to one of the sensors such as light sensor 9 so that if the light intensity reaches a value above a certain threshold, watch 100 returns to normal operating mode. The threshold used may the light intensity threshold used for the second criterion linked to light intensity data. Nonetheless, the normal operating mode will only be activated if the light intensity exceeds the threshold and not vice versa. It is clear that the measured physical magnitude, which is light intensity, is compared to a second light intensity threshold.

It will thus be clear that it is possible to envisage using the magnetic sensor. Microcontroller 1, when it receives a motion data item from the magnetic sensor, deems that the normal operating mode must be activated and activates said mode.

Thirdly, a solution consists in returning to normal operating mode at a fixed instant, i.e. when the time reaches a third time data item. This solution consists in programming data in microcontroller 1 representing an instant, formed of an hour data item, minute data item and second data item. The data provided by time base 5 is compared to this data item representative of an instant. Thus, until the data supplied by time base 5 does not match the data representative of an instant, watch 100 remains in a short standby mode. Otherwise, microcontroller 1 activates the change from short standby mode to normal operating mode by activating the digital display means 7*b*.

Figure 3:
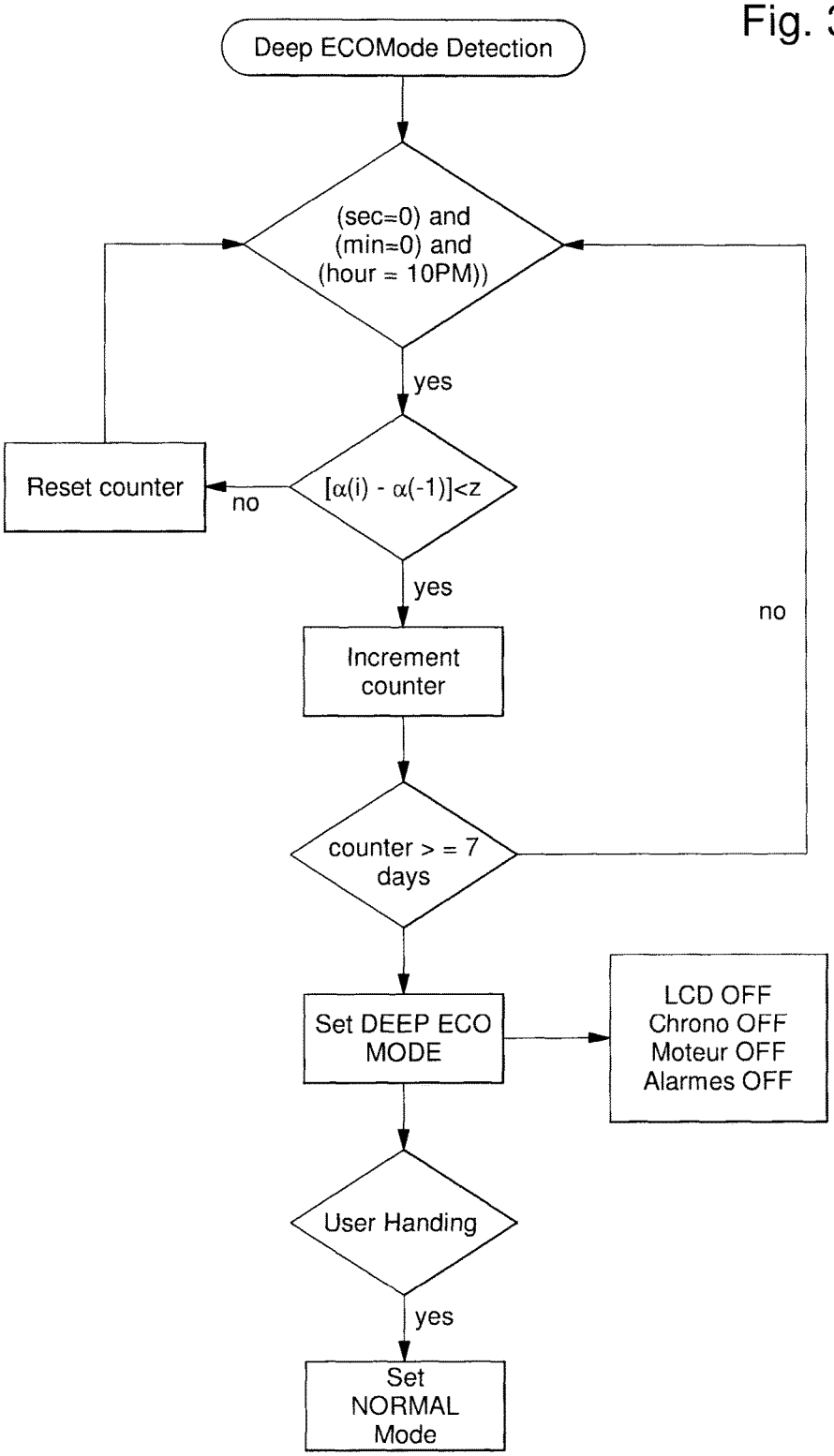
FIG. 3 is a schematic view of the long standby mode diagram of the invention.

In a second embodiment, there also exists a long standby mode, a diagram of which is shown in FIG. 3, arranged to be activated when watch 100 is not worn for a period of several days. For example, this long standby mode is activated when the user goes on holiday for several weeks without taking his watch 100. In order to activate the long standby mode, certain criteria must be satisfied. The purpose of these criteria is to inform microcontroller 1 that watch 100 is in a situation in which it can be placed on standby.

This long standby mode is activated by microcontroller 1 when various criteria are combined. These two criteria reliably determine when watch 100 should be placed in long standby mode. These criteria consist in ensuring that the long standby mode activation tests occur at regular intervals. Indeed, the long standby mode is set to be activated when, during a predefined period, the conditions indicating that long standby mode is possible are satisfied.

In this second embodiment, the step called step b), concerning the first criterion, then consists in monitoring and checking the time data supplied by time base 5, for example the current time provided to the user. When this time data is identical to a second time value which is predefined or entered by the user, said first criterion is deemed to be satisfied. For example, the predefined time data is 2200 hours. Thus, the first criterion will be satisfied when the time base indicates 2200 hours.

When this first criterion is satisfied, microcontroller 1 moves to the next step. This step, called step c), consists in testing the second criterion linked to a motion or orientation data item. Magnetic sensor 11 having two or three axes is used for this purpose. This magnetic sensor 11 is used to provide measurements representative of the orientation of watch 100 at regular intervals, and to compare the measurements to each other. If microcontroller 1 detects that the orientation of watch 100 at an instant Ti is identical to the orientation of watch 100 at an instant Ti−1 saved in a memory element, microcontroller 1 deduces that watch 100 is not being worn by the user. Microcontroller 1 deduces that watch 100 is not moving. There is a high probability that watch 100 is placed, for example, on the user's bedside table. However, if the orientation of watch 100 at an instant Ti is not identical to the orientation of watch 100 at an instant Ti−1, the orientation data for watch 100 at instant Ti is saved in a memory element and becomes the instant Ti−1 for a subsequent measurement.

When this second criterion is satisfied, the step called step d) is carried out, in which a counter is incremented. The incrementation of the counter means that the watch has not changed position between two instants for validating the first criterion. Returning to the example described above, this means that the watch has not changed position between day no 1 at 2200 hours and day no 2 at 2200 hours. Thus, if the watch has not changed position between day no 2 at 2200 hours and day no 3 at 2200 hours, the counter will be incremented again. Conversely, if the third criterion is not checked between an instant Ti and an instant Ti−1, then the counter is reset to zero so that the entire sequence is repeated. Indeed, the fact that the third criterion is not satisfied indicates that the watch has changed position and thus is being used by the user. The long standby mode is not required.

The value of the counter is compared, at each incrementation, to a first counter value, which may be pre-set or entered by the user. This criterion may be likened to a temporal criterion since the counter is incremented when microcontroller 1 notes that the position of the watch has not changed between an instant Ti and an instant Ti−1. This criterion is satisfied when the absence of movement of the watch between an instant Ti and an instant Ti−1 is checked several times in succession. Microcontroller 1 consequently understands that the watch is not being used and that it may be placed in long standby mode, i.e. step E) is activated.

In the present case, long standby mode is activated if microcontroller 1 detects, via magnetic sensor 11, that watch 100 is not being worn for a determined period of time. To achieve this, every evening at a set time, such as for example 2200 hours, magnetic sensor 11 measures a motion data item. If, for seven days, no significant difference in motion has been measured, then the long standby mode is activated.

Consequently, once the criteria are satisfied, microcontroller 1 will activate the change of operating mode of watch 100 so that the watch changes from normal operating mode to long standby mode. This long standby mode, called step E), is characterized in that analogue display means 7*a* and the digital display means are deactivated. The digital screen and the motors of the hands are thus no longer powered which saves energy.

The watch returns to normal operating mode when a second event occurs in step F). This second event is checked here when the user acts on activation means 13. Indeed, an action by the user on a push button informs microcontroller 1 that watch 100 is being worn by the user or at least that it is being used which requires the change from standby mode to normal operating mode.

Naturally, the instant at which the motion measurement is made can be chosen by the manufacturer or by the user. Likewise, the period during which the motion criterion must be positive may be different and can be set by the user. For example, watch 100 may enter long standby mode if, for three days at 1300 hours, magnetic sensor 11 does not measure any significant difference in the orientation of watch 100.

Evidently, it will be clear that watch 100 may integrate both standby modes, the short standby mode and the long standby mode but it may also only have one or the other.

In a variant, it is possible to use another sensor in order to tell whether watch 100 is being worn by the user or not. Indeed, it is possible to envisage providing watch 100 with a thermoelectric sensor 10. The human body has a specific body temperature which can be measured. Thus, thermoelectric sensor 10 converts the measured temperature into a voltage value representing temperature. The human body temperature varies between 36° and 38° C. for a human body temperature of 37° C.

This measured temperature-representative voltage is thus compared to two reference voltage values, each being representative of one of the limits of the time interval representing body temperature. Microcontroller 1 is thus responsible for comparing the measured temperature-representative voltage value to two reference voltage values. If the measured temperature-representative voltage value is comprised between the two reference voltage values then microcontroller 1 deduces that the watch is being worn. Conversely, if the measured temperature-representative voltage value is not comprised between the two reference voltage values, then microcontroller 1 deduces that the watch is not on the user's wrist.

This criterion is also tested between an instant Ti and an instant Ti−1 so that the criterion is as reliable as possible. In fact, if thermoelectric sensor 10 measures a temperature lower than 36° C. at instant Ti−1, and a temperature of between 36° C. and 38° C. at instant Ti, the microcontroller deduces that watch 100 is not being worn and that it is close to a source of heat. However, if thermoelectric sensor 10 measures a temperature of between 36° C. and 38° C. at instant Ti−1, and a temperature lower than 36° C. at instant Ti, microcontroller 1 deduces that watch 100 is not being worn. It is possible for thermoelectric sensor 10 to compare the measured temperature value to a temperature threshold representative of body temperature, such as 37° C.

It will be clear that various alterations and/or improvements and/or combinations evident to those skilled in the art may be made to the various embodiments of the invention set out above without departing from the scope of the invention defined by the annexed claims.

The invention claimed is:

1. A method of managing an electronic apparatus including a case containing a microcontroller powered with electrical energy by a mechanism to store electrical energy and connected to a time base, a mechanism to measure light intensity, a magnetic mechanism to detect whether said apparatus is being worn, said microcontroller also being connected to a first display comprising at least one hand set in motion by an electric motor and a second display comprising at least one digital display, arranged, in an active operating mode, to be controlled by the microcontroller to display at least a first temporal data item at least provided by the time base, the method comprising:

displaying at least said first temporal data item at least supplied by the time base corresponding to one said active operating mode;

testing a first criterion linked to a second temporal data item supplied by the time base against a first threshold linked to the second temporal data item to determine whether the first criterion is satisfied;

testing a second motion-linked criterion supplied by the magnetic mechanism against a second threshold linked to the second motion-linked criterion to determine whether the second criterion is satisfied and to detect whether said apparatus is being worn;

testing a third criterion representative of a physical magnitude against a third threshold linked to the physical magnitude to determine whether the third criterion is satisfied, the third criterion including a light intensity data item supplied by the mechanism to measure light intensity; and determining to change from the active operating mode, in which, the at least one digital display displays at least one of data supplied by the magnetic mechanism and data supplied by the mechanism to measure light intensity, to a standby mode, in which at least the at least one digital display is stopped, when the first, second, and third criteria are satisfied, and by performing said testing the first criterion linked to the second temporal data item before said testing the second motion-linked criterion and before said testing the third criterion that includes the light intensity data item, wherein said testing the first, second, and third criteria are performed until the first, second, and third criteria are satisfied and at regular intervals, calculated so that a position of a rotor of the electric motor of said at least one hand is identical in said testing the first, second, and third criteria, and so that a magnetic influence of the electric motor on said testing the first, second, and third criteria remains unchanged at each of the regular intervals, to cause a least possible magnetic interference.

2. The method of managing an electronic apparatus according to claim 1, wherein the third criterion allows the change from the active operating mode to a short standby mode in which the first display is stopped.

3. The method of managing an electronic apparatus according to claim 2, wherein said testing the third criterion includes comparing a light intensity value measured by said mechanism, to measure light intensity measuring to a first light intensity threshold, the third criterion being validated when the measured light intensity value is lower than or equal to said first light intensity threshold.

4. The method of managing an electronic apparatus according to claim 3, wherein said testing the first criterion includes comparing a time measurement made by the time base to a first time interval, the first criterion being satisfied when said time measurement by the time base is within said first time interval.

5. The method of managing an electronic apparatus according to claim 4, wherein the first criterion is tested first of all, and the second and third criteria are tested simultaneously when the first criterion is satisfied.

6. The method of managing an electronic apparatus according to claim 3, wherein the first criterion is tested first of all, and the second and third criteria are tested simultaneously when the first criterion is satisfied.

7. The method of managing an electronic apparatus according to claim 3, further comprising:

to change from the short standby mode to a normal operating mode, testing a first event and changing from the short standby mode to the normal operating mode when the testing of the first event is positive.

8. The method of managing an electronic apparatus according to claim 7, wherein said testing the first event includes detecting a change of electrical state of an activation mechanism.

9. The method of managing an electronic apparatus according to claim 7, wherein said testing the first event includes comparing a measured physical magnitude to a reference value of said physical magnitude, the first event being satisfied when said measured physical magnitude is identical to said reference value of said physical magnitude.

10. The method of managing an electronic apparatus according to claim 9, wherein the measured physical magnitude is light intensity, the measured light intensity value being compared to a second light intensity threshold.

11. The method of managing an electronic apparatus according to claim 10, wherein said second light intensity threshold is identical to the first light intensity threshold.

12. The method of managing an electronic apparatus according to claim 9, wherein, the measured physical magnitude is a temporal data item, the measured temporal data item being compared to a third time value.

13. The method of managing an electronic apparatus according to claim 2, wherein said testing the first criterion includes comparing a time measurement made by the tame base to a first time interval, the first criterion being satisfied when said time measurement by the time base is within said first time interval.

14. The method of managing an electronic apparatus according to claim 4, wherein the first criterion is tested first of all, and the second and third criteria are tested simultaneously when the first criterion is satisfied.

15. The method of managing an electronic apparatus according to claim 2, wherein, the first criterion is tested first of ell, and the second and third criteria are tested simultaneously when the first criterion is satisfied.

16. The method of managing an electronic apparatus according to claim 1, wherein said testing the second criterion includes testing a second criterion linked to motion data provided by the magnetic mechanism to detect whether said apparatus is being worn, and includes:

at an instant Ti, performing a first measurement of a position of said apparatus via the magnetic mechanism of said apparatus; and comparing said first measurement to a second measurement stored in a memory element and performed instant ti−1, the second criterion being validated when the first and second measurements are identical, otherwise replacing a memory element value with the first measurement performed at instant Ti.

17. The method of managing an electronic apparatus according to claim 1, wherein said testing the first, second, and third criteria are performed every eight minutes until the first, second, and third criteria are satisfied so as to generate the least possible interference.

18. A method of managing an electronic apparatus including a case containing a microcontroller powered with electrical energy by a mechanism to store electrical energy and connected to a time base, a mechanism to measure light intensity, a mechanism to detect whether said apparatus is being worn, said microcontroller also being connected to a first display comprising at least one hand set in motion by an electric motor and a second display comprising at least one digital display, arranged, in an active operating mode, to be controlled by the microcontroller to display at least a first temporal data item at least provided by the time base, the method comprising:

displaying at least said first temporal data item at least supplied by the time base corresponding to one said active operating mode;

testing a first criterion linked to a second temporal data item supplied by the time base against a first threshold linked to the second temporal data item to determine whether the first criterion is satisfied;

testing a second motion-linked criterion supplied by the mechanism against a second threshold linked to the second motion-linked criterion to determine whether the second criterion is satisfied and to detect whether said apparatus is being worn;

testing a third criterion representative of a physical magnitude against a third threshold linked to the physical magnitude to determine whether the third criterion is satisfied, the third criterion including a light intensity data item supplied by the mechanism to measure light intensity; and determining to change from the active operating mode to a standby mode when the first, second, and third criteria are satisfied, and by performing said testing the first criterion linked to the second temporal data item before said testing the second motion-linked criterion and before said testing the third criterion that includes the light intensity data item, wherein said testing the first, second, and third criteria are performed until the first, second, and third criteria are satisfied and at regular intervals, calculated so that a position of a rotor of the electric motor of said at least one hand is identical in said testing the first, second, and third criteria, and so that a magnetic influence of the electric motor on said testing the first, second, and third criteria remains unchanged at each of the regular intervals, to cause a least possible magnetic interference.

19. The method of managing an electronic apparatus according to claim 18, wherein said testing the third criterion including testing a value of a counter with respect to a first counter value, said testing the value of the counter with respect to the first counter value permitting the change from the active operating mode to a long standby mode in which the first display and the second display are stopped.

20. The method of managing an electronic apparatus according to claim 19, wherein said testing the first criterion includes comparing a time data item delivered by the time base to a second time value, said first criterion being satisfied when said time data item delivered by the time base is identical to the second time value.

21. The method of managing an electronic apparatus according to claim 19, wherein the first criterion is tested first of all, and the second criterion is tested when the first criterion is satisfied, and when the second criterion is satisfied, the counter value is incremented and the third criterion is tested.

22. The method of managing an electronic apparatus according to claim 19, further comprising:

to change from the long standby mode to a normal operating mode, testing a second event and changing from the long standby mode to the normal operating mode when the testing of the second event is positive.

23. The method of managing an electronic apparatus according to claim 22, wherein said testing the second event includes comparing a measured time data item to a fourth time value.

24. The method of managing an electronic apparatus according to claim 18, wherein said testing the first criterion includes comparing a time measurement made by the time base to a first time interval that is set by a user of the electronic apparatus.

25. The method of managing an electronic apparatus according to claim 18, wherein said testing the third criterion includes comparing a light intensity value measured by said mechanism to measure light intensity measuring to a first light intensity threshold that is set by a user of the electronic apparatus.

26. The method of managing, an electronic apparatus according to claim 18, wherein in the active operating mode, the digital display displays at least one of data supplied by the mechanism to detect whether said apparatus is being worn and data supplied by the mechanism to measure light intensity, and in the standby mode, at least the digital display is stopped.

27. An electronic apparatus comprising:

a case containing a microcontroller powered with electrical energy by a mechanism to store the electrical energy and connected to a time base;

a mechanism to measure light intensity; and a mechanism to detect whether said apparatus is being worn;

said microcontroller also being connected to a first display comprising at least one band set in motion by an electric motor and a second display that is a digital display, arranged, in an active operating mode, to be controlled by an electronic control circuit to display at least a first temporal data item at least provided by the time base and a standby mode, said microcontroller is configured to activate a change from the active operating mode to the standby mode by testing a first criterion linked to a second temporal data item provided by the time base against a first threshold linked to the second temporal data item to determine whether the first criterion is satisfied, by testing a second criterion linked to a motion data item provided by the mechanism against a second threshold linked to the second motion-linked criterion to determine whether the second criterion is satisfied and to detect whether said apparatus is being worn, and by testing a third criterion representative of a physical or temporal magnitude against a third threshold linked to the physical or temporal magnitude to determine whether the third criterion is satisfied, the third criterion including a light intensity data item supplied by the mechanism to measure light intensity, said microcontroller is configured to determine to change from the active operating mode to the standby mode when the first, second, and third criteria are satisfied, said microcontroller is configured to test the first criterion linked to the second temporal data item before testing the second criterion linked to the motion data item and before testing the third criterion that includes the light intensity data item, and said microcontroller is configured to perform testing of the first, second, and third criteria until the first, second, and third criteria are satisfied and at regular intervals, calculated so that a position of a rotor of the electric motor of said at least one hand is identical in said testing the first, second, and third criteria, and so that a magnetic influence of the electric motor on said testing the first, second, and third criteria remains unchanged at each of the regular intervals, to cause a least possible magnetic interference.

28. The electronic apparatus according to claim 27, wherein the third criterion allows the change from the active operating mode to a short standby mode in which the first display is stopped.

29. The electronic apparatus according to claim 28, wherein the light intensity data item is obtained by said microcontroller comparing a light intensity value measured by said mechanism to measure light intensity to a first light intensity threshold.

30. The electron c apparatus, according to claim 27, wherein the first criterion includes said microcontroller comparing a time measurement made by the time base to a first time interval to tell whether said time measurement by said time base is comprised within said first time interval.

31. The electronic apparatus according to claim 27, wherein the third criterion includes said microcontroller testing a value of a counter with respect to a first counter value, said testing the value of the counter with respect to the first counter value permitting the change from the active operating mode to a long standby mode in which the first display and the second display are stopped.

32. The electronic apparatus according to claim 27, wherein the first criterion includes said microcontroller comparing a temporal data item delivered by the time base to a second time value, said first criterion being satisfied when said temporal data item delivered by the time base is identical to the second time value.

33. The electronic apparatus according to claim 27, wherein the motion data item includes the mechanism to detect whether said apparatus is being worn performing, at an instant Ti, a first position measurement of a position of said apparatus and said microcontroller comparing said first measurement to a second measurement stored in a memory element, the third criterion being validated when the first and second measurements are identical.

34. The electronic apparatus according to claim 33, wherein the mechanism to detect whether said apparatus is being worn includes a magnetic sensor.

35. The electronic apparatus according to claim 34, wherein the magnetic sensor is replaced by an accelerometer which is arranged inside the case and which includes at least one measurement axis of an acceleration to which the electronic apparatus is subjected.

36. The electronic apparatus according to claim 27, wherein the mechanism to detect whether said apparatus is being worn includes a thermoelectric sensor, the motion data item supplied by the thermoelectric sensor includes said microcontroller comparing a measurement made by the thermoelectric sensor to a temperature threshold representative of body temperature.

37. The electronic apparatus according to claim 27, wherein the second display includes at least one digital screen.

38. The electronic apparatus according to claim 27, in the active operating mode, the digital display displays at least one of data supplied by the mechanism to detect whether said apparatus is being worn and data supplied by the mechanism to measure light intensity, and in the standby mode, at least the digital display is stopped.

* * * * *